United States Patent [19]

Browning

[11] 4,452,171

[45] Jun. 5, 1984

[54] MATERIAL HANDLING APPARATUS

[76] Inventor: Jess Browning, 4217 Via Pinzon, Palos Verdes Estates, Calif. 90274

[21] Appl. No.: 398,869

[22] Filed: Jul. 16, 1982

[51] Int. Cl.[3] ..... B05C 11/00

[52] U.S. Cl. ..... 118/58; 118/69; 118/72; 118/423; 118/428; 118/503

[58] Field of Search ..... 118/58, 69, 72, 423, 118/428, 503

*Primary Examiner*—Bernard D. Pianalto

*Attorney, Agent, or Firm*—Blakely, Sokoloff, Taylor & Zafman

[57] ABSTRACT

A machine and process for automatically coating a plurality of objects, each object having a first magnetic end and a second end. At one end of the machine is a feeding area containing a revolving drum having a plurality of parallel rows of magnets affixed thereon. The magnets are arranged in pairs having opposite polarity so that each pair may attract a magnetic end of one of the objects in the bin and can align the magnetic end therebetween. Parallel and adjacent to each row of magnets is a receiving bar which is also affixed to the drum. As the drum revolves, gravity encourages the second ends into the channels in the receiving bars, to be clamped therein by a tension mounted clamp, leaving the magnetic ends now free. Adjacent to the revolving drum containing the clamped objects is a conveyor with a plurality of grippers to receive the exposed magnetic ends of the objects and remove them from the drum. The objects are then mechanically held by their magnetic ends such that the second ends hang free beneath the conveyor for passage through cleaning, coating and drying stations prior to release.

14 Claims, 10 Drawing Figures

Fig. 5
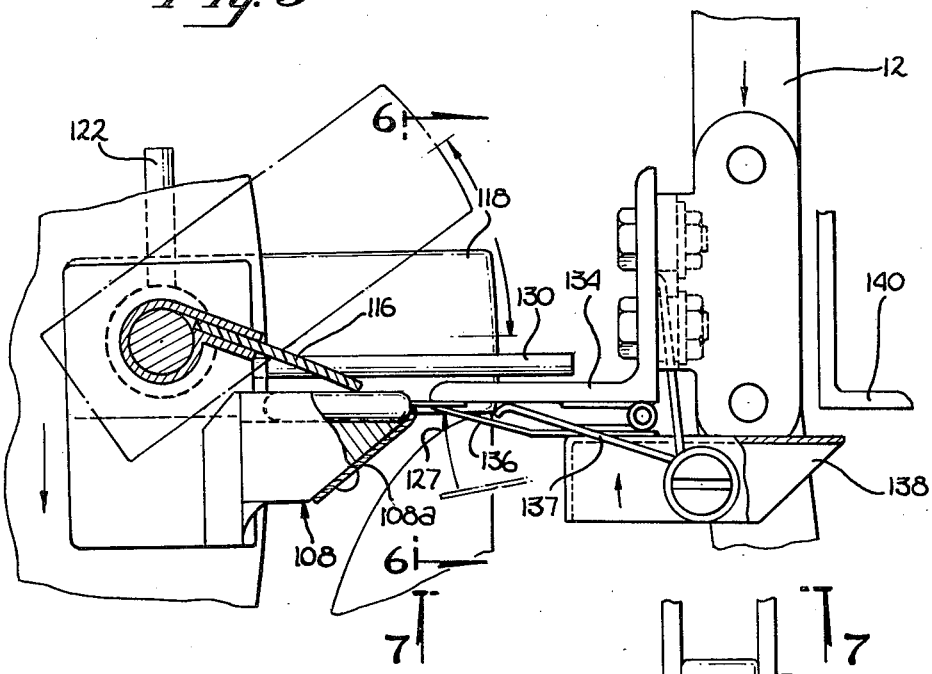
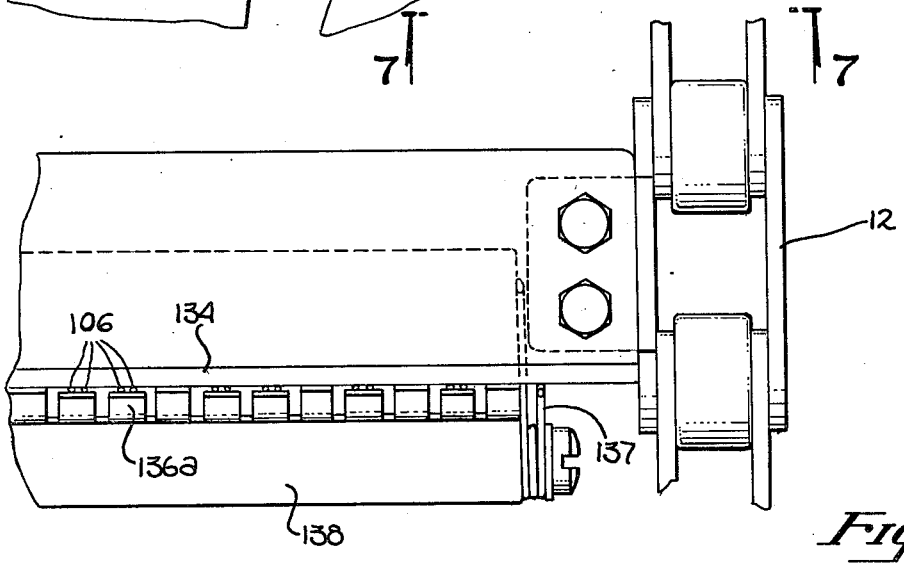
Fig. 6
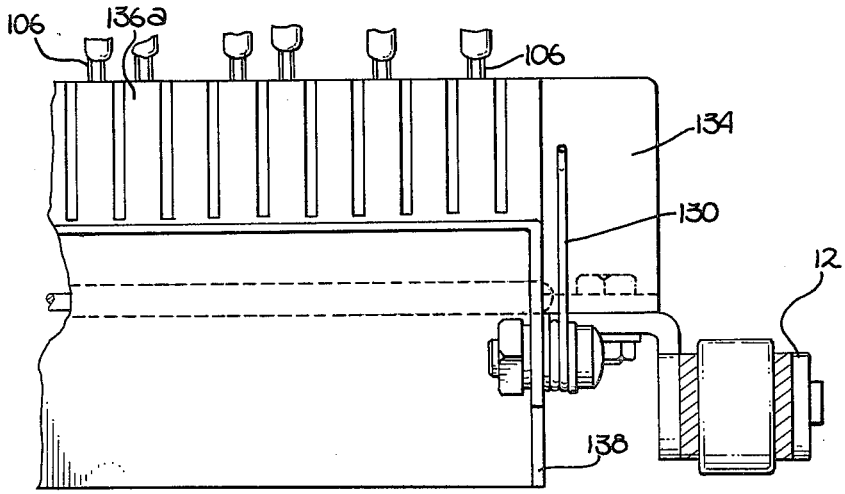
Fig. 7

MATERIAL HANDLING APPARATUS

BACKGROUND OF THE INVENTION

1. Field of the Invention

This invention relates to coating and material handling machines. More specifically, this invention relates to automatic coating and material handling machines for objects such as light bulbs, and the like in which only a part of the objects is coated.

2. Prior Art

There are many problems inherently associated with methods and apparatus' for coating a small object that can't be totally dipped. For example, the objects must be all aligned in one direction so that the same part of all the objects will be coated. The dipping of the objects in the coating must be carefully controlled so that each object is uniformly coated and such that there is no coating on the area on which no coating is desired. Further, each coat must be completely dried before an additional coat is added which is quite time consuming and expensive when several thousand objects must be coated. For a high volume product such as tiny test tube shaped Christmas tree light bulbs, a fast and inexpensive method and apparatus is desired to place the variety of different colors on the bulb such that the coating cost per unit is as low as possible and the leads of the bulbs remain uncoated. Further, a method in which these objects may be recoated, in a minimum amount of time if an additional coat is required, would be of substantial advantage to the art.

SUMMARY OF THE INVENTION

The present invention is a machine and process for automatically coating a plurality of objects, each object having a first magnetic end and a second end. At one end of the machine is a feeding area. The feeding area has a bin in which the objects to be coated are placed. In the feeding area, partially within the feeding bin, is a revolving drum having a plurality of parallel rows of magnets affixed thereon. The magnets on each row are arranged in pairs having opposite polarity so that each pair of magnets may attract a magnetic end of one of the objects on the surface of the objects in the bin and can align the magnetic end therebetween.

Parallel and adjacent to each row of magnets is a receiving bar which is also affixed to the drum. Each receiving bar has a plurality of channels corresponding to and aligned with each pair of magnets. The second ends of the objects, whose magnetic ends have been aligned between the pairs of magnets, sag behind as the drum revolves in a clockwise direction, until gravity encourages the second ends into the channels in the receiving bars. Nonaligned objects are not sufficiently retained in the channels and fall back into the bin for reloading.

Attached to each receiving bar is a tension mounted clamp. Each clamp fits over the channels in the receiving bar. The second ends of the objects are clamped within the channels by the flexible edge of the tension mounted clamp after being encouraged therein by gravity. The receiving bar containing the clamped objects is then rotated radially outward such that the magnetic ends of the objects are pulled away from the force of the magnets and are fully exposed such that they protrude outward from the channels.

Adjacent to the revolving drum containing the clamped objects is a conveyor. The conveyor comprises a pair of parallel chains with a plurality of grippers supported therebetween. The exposed magnetic ends on the revolving drum are gripped by the grippers on the conveyor while the second ends are simultaneously unclamped from the channels. The objects are then mechanically held by their magnetic ends such that the second ends hang free beneath the conveyor.

The conveyor carries the objects away from the feeding area to an area where the objects may be cleaned prior to being coated. The objects travel to a coating area in which a tub of paint or other coating material is placed. The objects travel through the paint to provide an evenly distributed coat by means of timely withdrawl from the paint. The objects may then be cured and unloaded. The invention provides a method of coating the second ends of the objects more than once by repeating the coating and curing steps.

The material handling portion of the machine may also be adapted to other processes such as electrical test of Christmas tree light bulbs. Such adaptation is relatively simple, in that the drum pickup system aligns the bulbs with the leads extending, whereupon the leads may be gripped be electrically contacting grippers with a voltage therebetween, with the absence of current (or excessive current) indicating a bad bulb.

BRIEF DESCRIPTION OF THE DRAWINGS

FIG. 5 is an enlarged view of the gripper and clamped bulb taken along line 5 of FIG. 4.

FIG. 6 is a partial end view looking at the grippers along line 6—6 of FIG. 5.

FIG. 7 is a partial end view of the clamped bulbs taken along line 7—7 of FIG. 5.

DETAILED DESCRIPTION OF THE INVENTION

Figure 1:
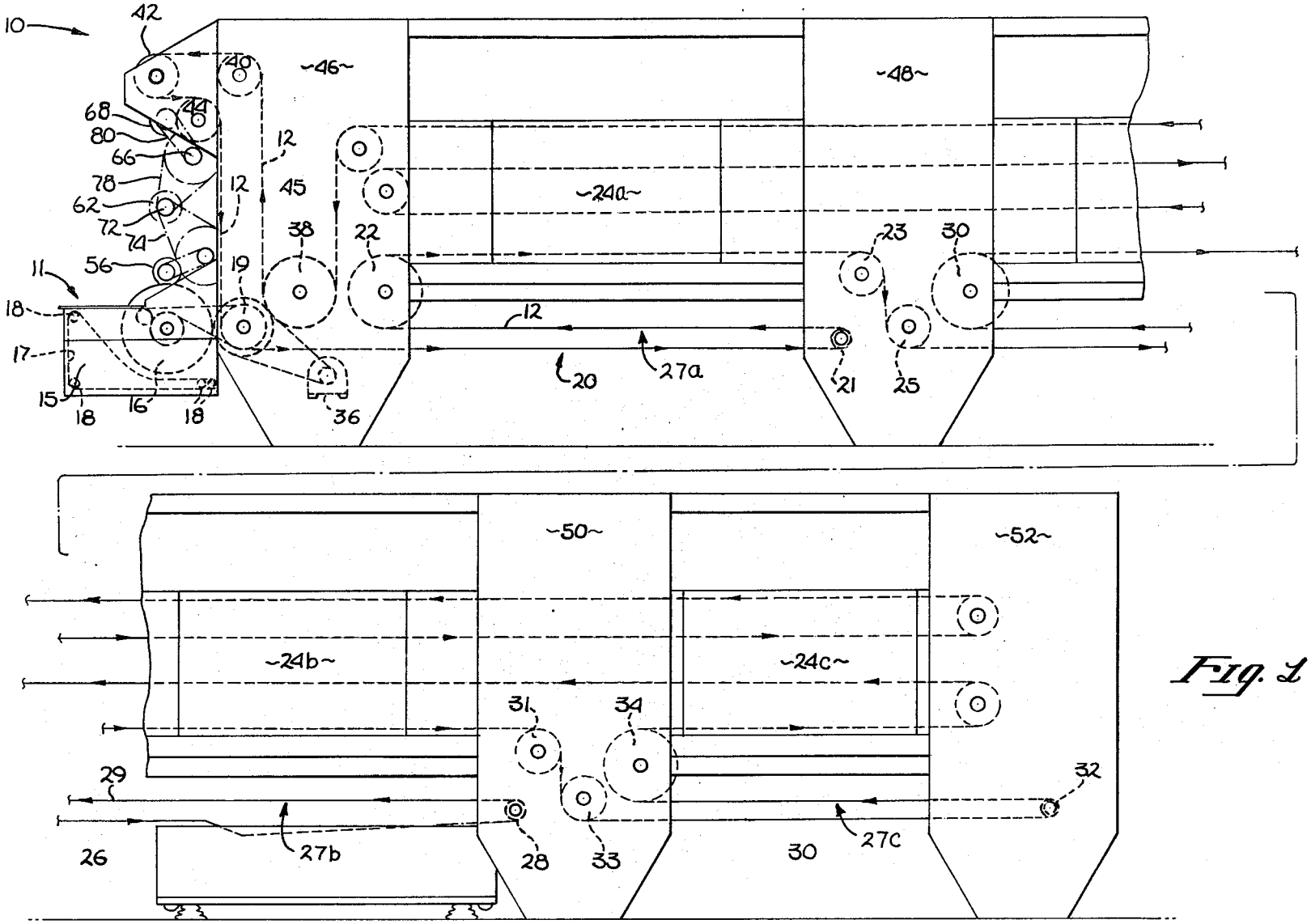
FIG. 1 is a side view of the automatic coating machine of the present invention illustrating the conveyor path, and the feeding and unloading areas of the machine.
Figure 8:
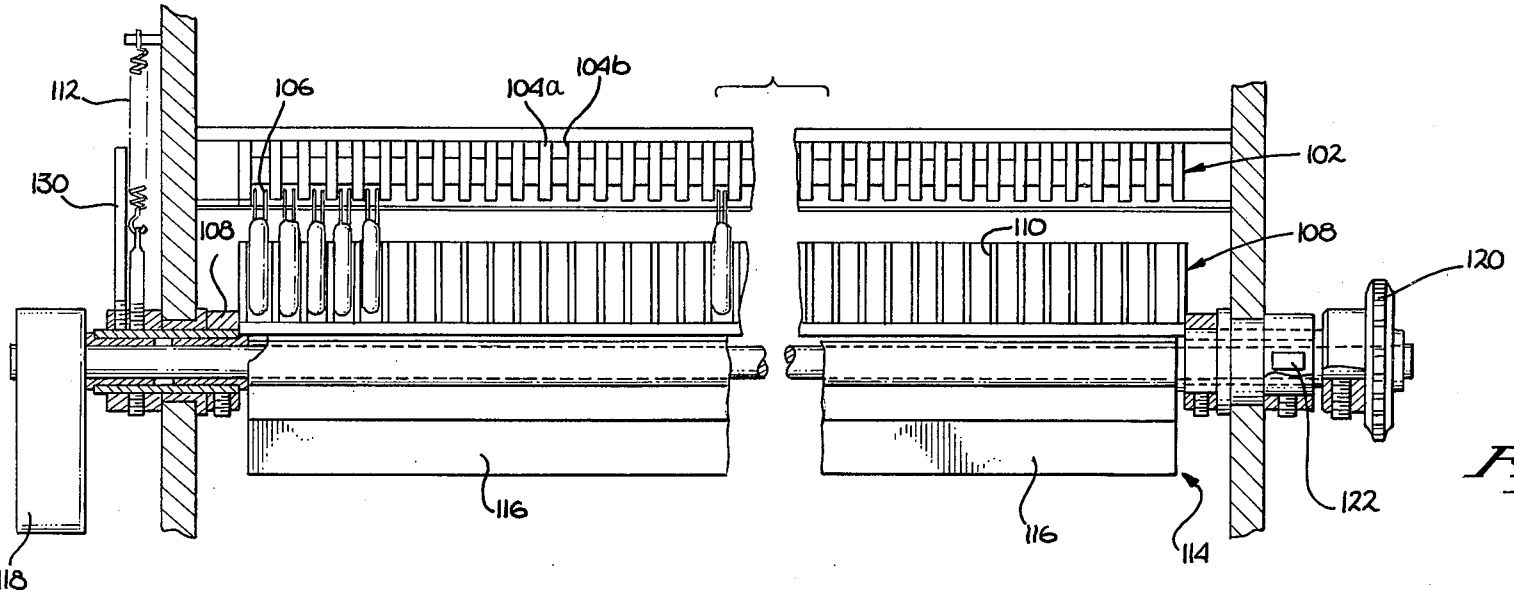
FIG. 8 is a frontal view of the row of magnets, compartments, and clamps taken along lines 8—8 of FIG. 4.

Referring first to FIG. 1, a pictorial illustration of the automatic coating and material handling machine 10 of the present invention is shown. At one end of the machine 10, near the control panel 45, is a feeding area 14. The feeding area has a bin 15 in which the objects to be coated are placed. In the preferred embodiment, the objects to be coated are tiny test tube shaped glass Christmas tree light bulbs such as is shown in FIG. 8; however, any object having a magnetically attractable end may be used with suitable modifications of the machine. In the description to follow; a general overview is first given, followed by more detailed descriptions of the apparatus.

Partially within feeding bin 15, is a revolving drum 16 having a plurality of parallel rows of magnets affixed thereon. The bin 15 is seen to be defined, in part by a belt 17, supported on rollers 18, driven at approximately the same speed as the surface speed of the drum 16, so as to provide a yieldable support for the bulbs in the vicinity of the drum. The magnets are arranged in pairs having opposite polarity so that each pair may attract the leads of one of the bulbs that are on the surface of the bulbs in bin 15 and then may align the leads therebetween. The glass ends of the bulbs sag behind the leads as the drum revolves in a clockwise direction until gravity encourages the glass ends of the bulbs into channels in a receiving bar which is parallel and adjacent to each row of magnets. Non-aligned bulbs fall back into bin 15. The glass ends of the bulbs are confined in the channels by a tension or gravity weighted mounted clamp which is attached to each receiving bar, each clamp having individual prongs which fit into each channel. The clamped bulbs are then rotated radially outward such that the leads are fully exposed and protrude outward from the channels. The leads of the bulbs are gripped by grippers on a conveyor 12 while the glass ends are simultaneously unclamped from the channels. The bulbs are held by their leads such that the glass portion hangs free beneath the conveyor 12.

The conveyor 12 carries the bulbs to an area 20 where the bulbs may be cleaned prior to being coated. The arrows illustrate the direction and path of conveyor 12. In the preferred embodiment, the bulbs are cleaned by being pulled through an alcohol based solvent in an ultrasonic tank placed in area 20 which causes any dust or oils that may have accumulated on the glass to be removed. After cleaning, the conveyor travels around a sprocket 21 into flash off tunnel 27*a*. Sprocket 21 has a relatively small diameter such that the conveyor will make a quick revolution around it. Since the bulbs travel along a longer path than the conveyor, the linear speed of the bulbs will increase in making the turn such that solvent remaining on the bulb will drip to the bottom of the bulb or be sprayed off due to centrifugal forces. Flash off tunnel 27*a* removes any excess solvent on the bulbs prior to their being conveyed into an oven 24*a* where the bulbs are dried. The oven, 24*a* is a combination of infrared heater and recirculating fan to cure the coating in the shortest time possible. The oven walls, in this embodiment, are insulated with four inches of insulation to assure maximum heating efficiency and minimize operating costs.

Figure 10:
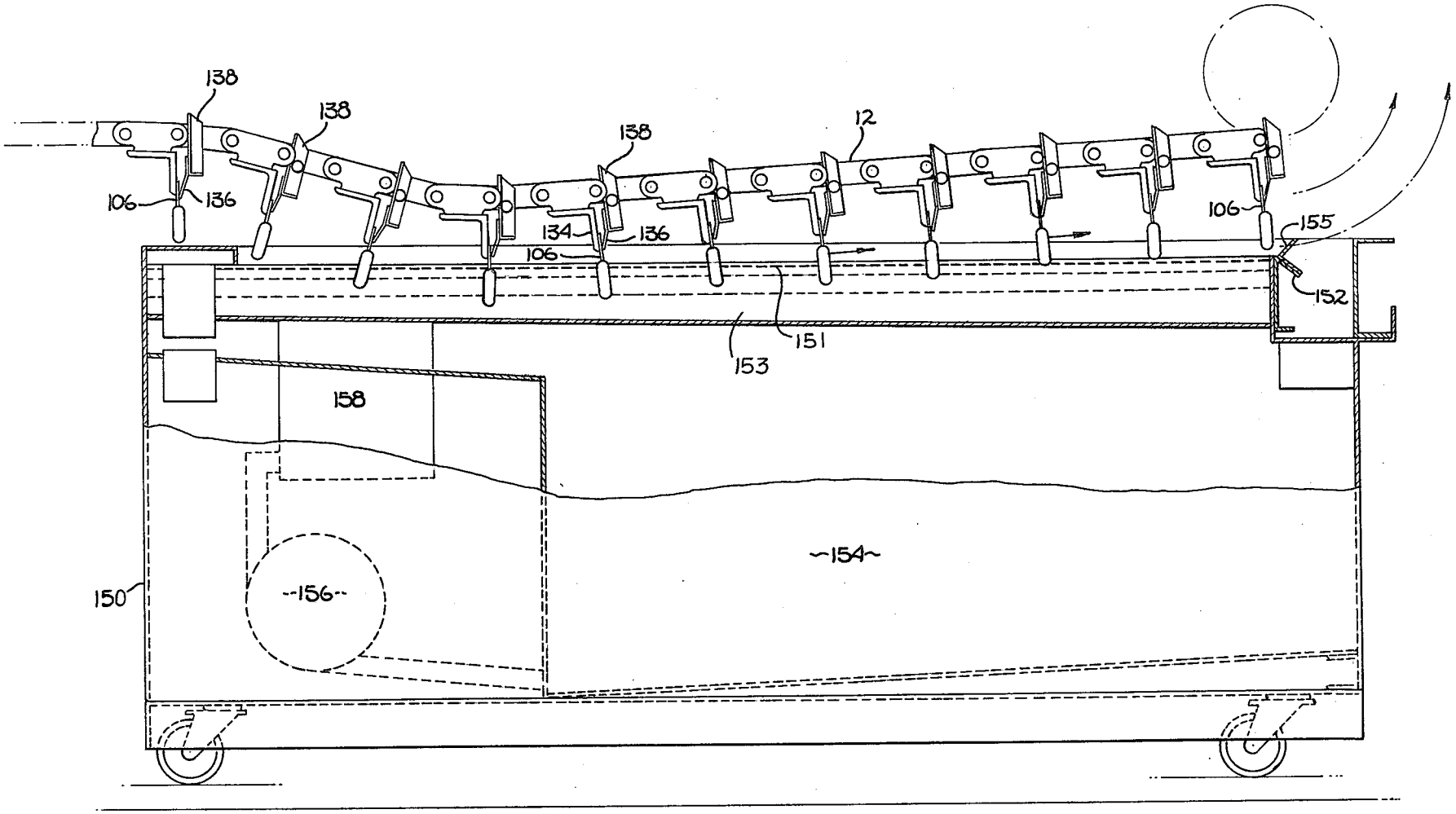
FIG. 10 is an illustration of the coating tank used in the present invention.

After drying, the bulbs may be cooled down to a temperature optimal for coating by a fan placed in support member 48. The cooled bulbs on the conveyor 12 travel over 23*a* and 25*a* to a coating area 26 at the bottom of the coating machine 10 between supports 48 and 50. A tub of paint or other coating material, such as is shown in FIG. 10, is placed in area 26. The bulbs travel through the paint for a period of approximately 10 seconds followed by gradual withdrawl to provide an evenly distributed first coat. The conveyor 12 then travels around a sprocket 28, having a diameter similar to that of sprocket 21 such that the gravitational force on the coating causes any excess paint to reversse flow to the bottom of the bulbs. Between sprocket 28 and sprocket 30, any excess paint solvent on the bulbs is evaporated in flash off tunnel 27. The bulbs then travel into the oven 24 where the pain is cured.

After the paint is cured, the conveyor 12 travels around sprockets 31 and 33 to a second coating area 30. A tub of coating, similar to the paint in area 26, is placed in area 30 if an additional coat of paint is desired through which the bulbs will travel in a manner similar to that occurring in area 26. Otherwise this area may be left empty and the bulbs are conveyed back into the flash off tunnel and then into the oven for final curing.

After the second coating, if any, the conveyor will travel around a sprocket 32 having the same diameter as sprocket 28 such that the gravitational force on the coating cause any excess paint to reverse flow to the bottom of the bulb. The excess paint solvent on the bulbs is evaporated in flash off tunnel 27*c* prior to the bulbs being conveyed around sprocket 34 into the oven 24*c* for final curing. The bulbs travel back and forth through the ovens 24*a*, 24*b* and 24*c* for final curing of the coating which, in the preferred embodiment, takes approximaely 10 minutes.

If desired, the machine may be lengthened and additional coating areas similar to 26 and 30 may be added, along with similar modifications of the conveyor 12 to provide additional coatings prior to the final curing. After the final curing, the conveyor travels around sprockets 38, 40 and 42, and the bulbs are released into an unloading bin (not shown). Any excess bulbs that may remain on the conveyor, are knocked off by a rotating brush 68 prior to the conveyor returning to the feeding bin 15.

The coating machine of the present invention has two steel walls supported by support members 46, 48, 50 and 52 and corresponding support members 47, 49, 51 and 53 (not shown) on the other side. In the preferred embodiment, the enclosure consists of high density mineral wool compressed to 4" thickness between 20 gauge steel sheets to form an enclosure of articulated panels. Structural steel is provided to support the enclosure, equipment, and ductwork. Mounted on the support member 46, is the control panel 45 (not shown in detail) which contains the controls for the speed of the conveyor, the temperature of the oven, and the necessary combination of magnetic motor starters and disconnect switches. The control panel also indicates the various temperatures and operating status' of the different parts of the machine.

In the center of the machine 10 are the ovens 24*a*, 24*b* and 24*c* and the flash off tunnels 27*a*, 27*b* and 27*c* which extends from support member 46 through the center of the machine to support member 52. The flash off tunnels 27*a*, 27*b* and 27*c* has an exhaust fan to remove any evaporated solvents or paint. The ovens 24*a*, 24*b* and 24*c* is a combination infrared heater and recirculating fan to cure the coating in the shortest time possible. The oven walls are insulated with 4" of insulation to assure maximum heating efficiency and to minimize operating costs.

Figure 2:
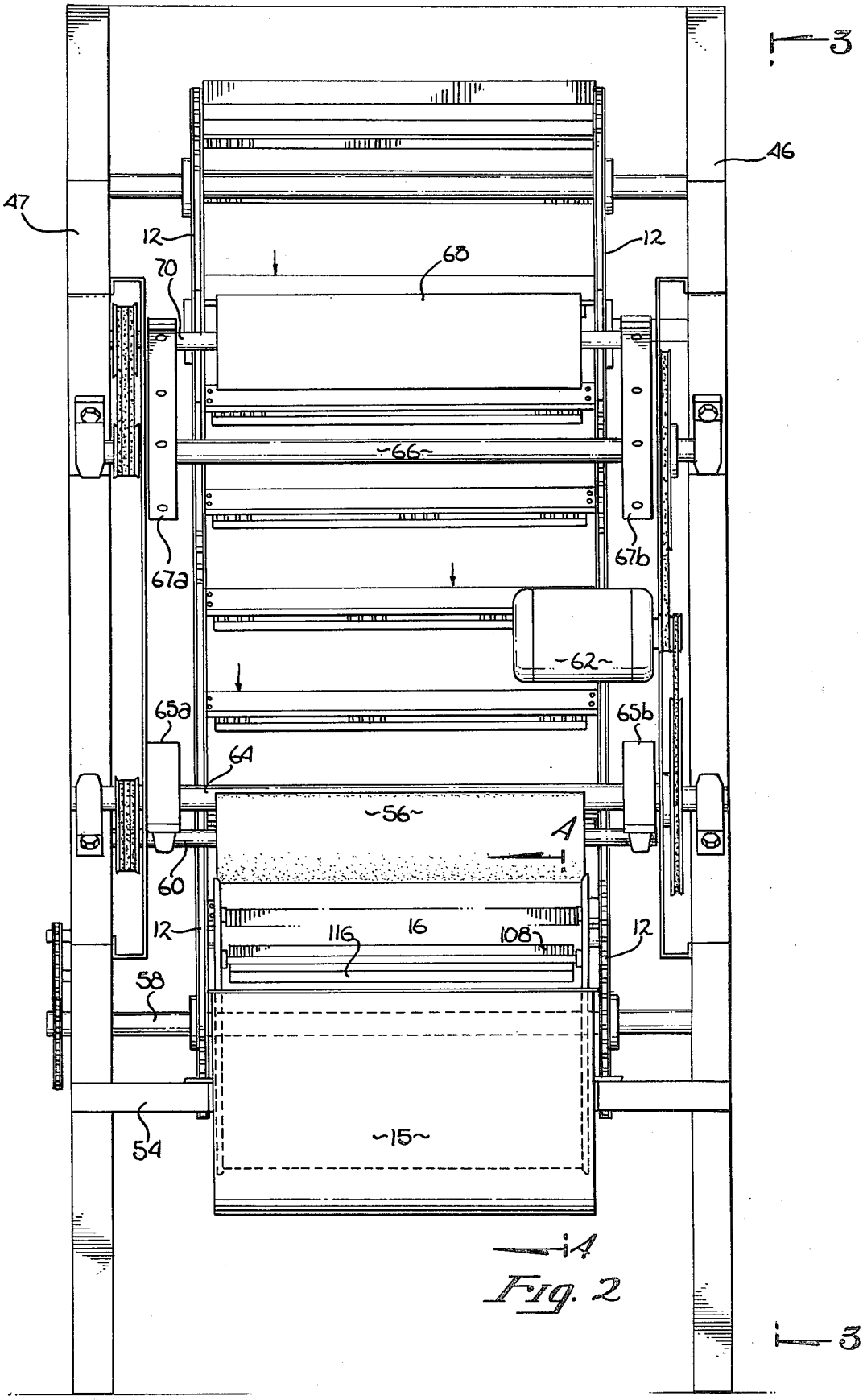
FIG. 2 is an illustration of the feeding area and unloading area of the automatic coating machine of the present invention.

Referring next to FIG. 2, an end view of the feeding area of the coating machine 10 of FIG. 1 is illustrated. The feeder bin 15 is mounted on a feeder support bar 54 affixed to support members 46 and 47. Bin 15 is positioned underneath drum 16 which is rotatably mounted on a shaft 58. A brush 56 is rotatably mounted on a shaft 60 and aligned over drum 16. The brush 56 rotates at a speed in a counterclockwise direction such that the peripheral speed of the brush is greater than the peripheral speed of the drum 16. In this manner, the bristles of brush 56 can straighten the lead ends of the bulbs which are magnetically aligned on drum 16. A motor 62 is mounted on support member 46. The motor provides the drive for the various shafts as will be discussed in greater detail in relation to FIG. 3. Also mounted on support members 46 and 47 are brackets 65*a* and 65*b* and 67*a* and 67*b* having rods 64 and 66 respectively extending therebetween which provide stability against the motion of the feeding area. Second brush 68, rotatably mounted on shaft 70, is positioned above rod 66 to brush off any bulbs that have become attached to the grippers of the conveyor due to dried paint as the bulbs are unloaded.

Figure 3:
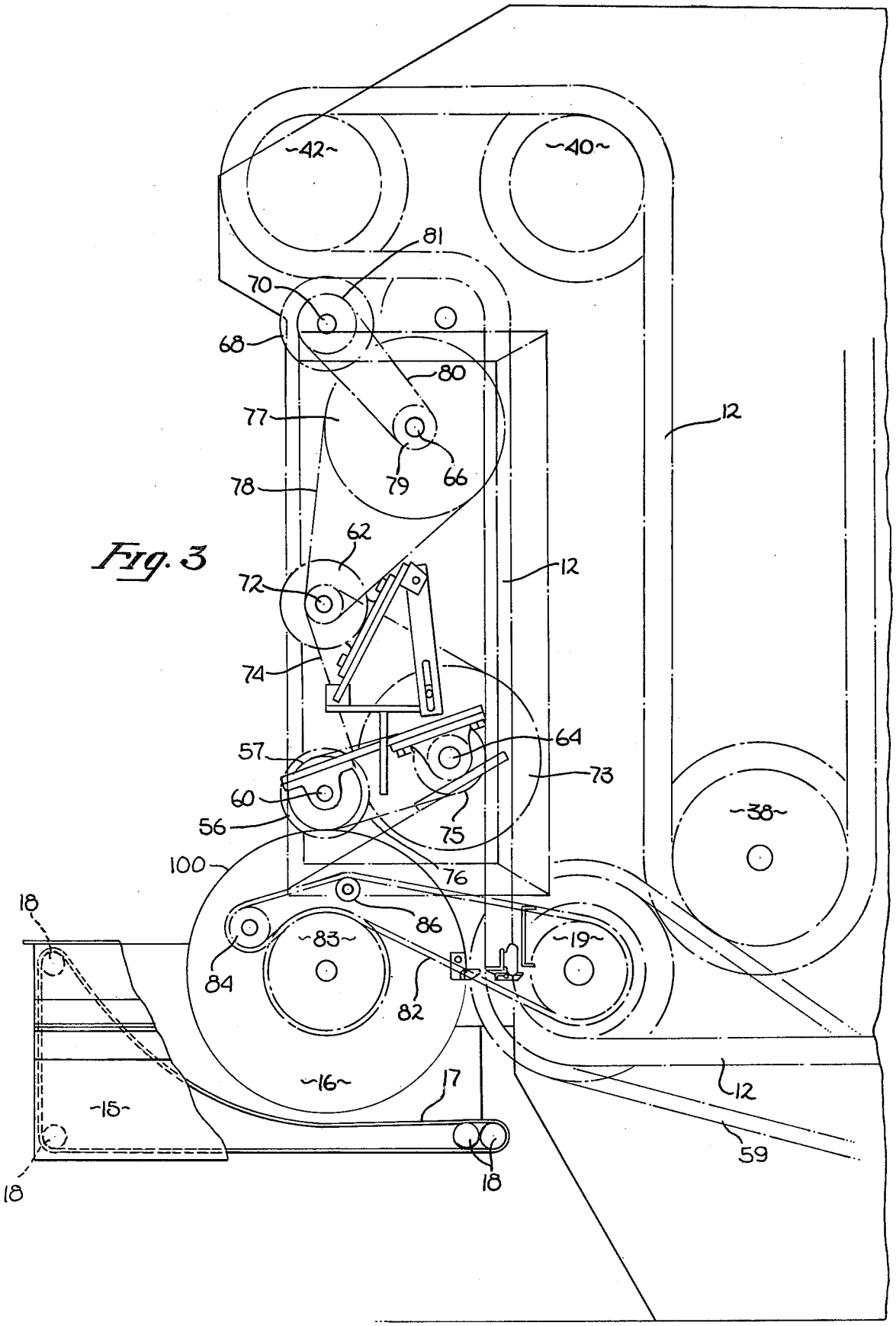
FIG. 3 is an enlarged view of the control portion of the automatic coating machine.

Referring next to FIG. 3, an enlarged end view of the pulleys, shafts and belts driven by motor 62 is shown. Around the shaft 72 of motor 62 is an open belt 74 such that motor 62 drive the pulley 73 on rod 64. A belt 76 is mounted around a pulley 75, connected to rod 64, and a pulley 57, affixed to shaft 60 of brush 56. Pulley 75 has a smaller diameter than and is concentrically affixed to pulley 73 such that when motor 62 drives pulley 75, it will also drive pulley 73 which causes brush 56 to rotate. A belt 78 is mounted around the shaft 72 of motor 62 and an outer pulley 77 affixed to rod 66 to drive rod 66. Concentrically affixed to pulley 77 is a pulley 79 which is coupled to a pulley 81 by a belt 80 to drive brush 68.

The drum 16 and the conveyor 12 are coupled together by a roller chain 82 mounted around sprockets 19, 83, 84 and 86. Sprockets 84 and 86 are mounted so as to allow unrestricted circular motion of the drum 16. The sprocket 19 is coupled to a second motor 36 by a roller chain 59. Thus, the second motor 36 drives the conveyor 12 and the drum 16.

Figure 4:
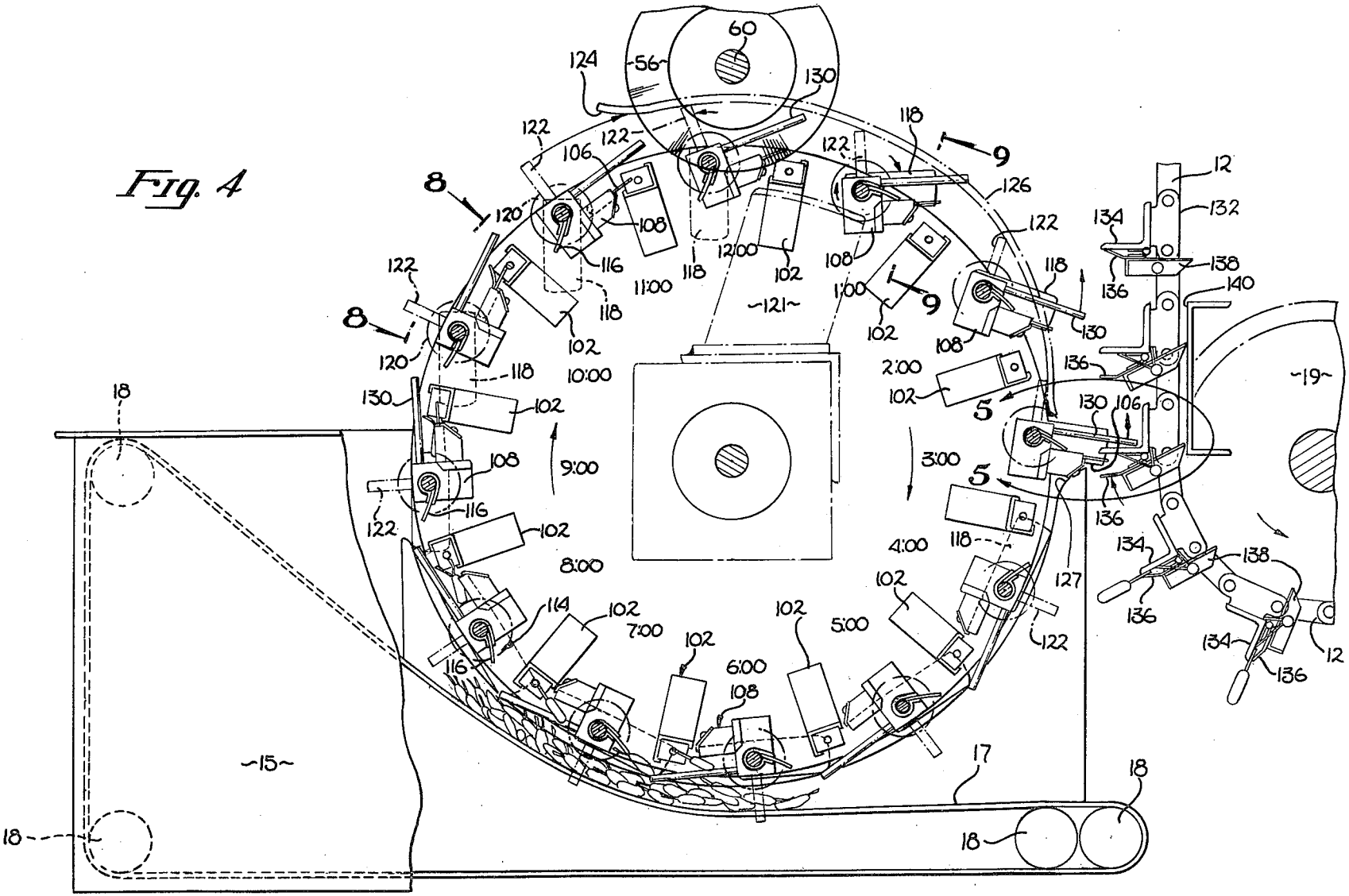
FIG. 4 is a vertical section of the feeding area of the machine taken along lines 4—4 of FIG. 2.
Figure 9:
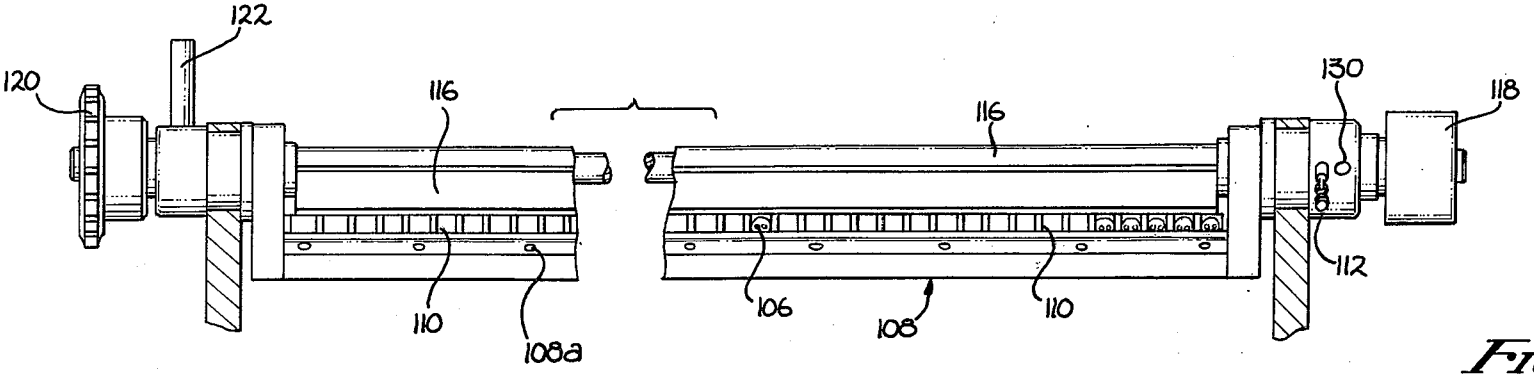
FIG. 9 is a view looking down into the compartments taken along line 9 of FIG. 4.

Referring next to FIGS. 4, 8, and 9, the feeding portion of FIG. 2 is illustrated. The revolving drum 16 has an outer wall 100 onto which a plurality of parallel rows 102 of magnets 104 are attached. In the preferred embodiment, there are 12 rows of magnets. The magnets on each row are arranged in pairs such as 104*a* and 104*b* in FIG. 8. Each pair of magnets are polarized so as to attract and align the leads 106 of each of the bulbs. Each pair of magnets exert enough force on the leads to cause the bulbs to sag around the outside of the drum. Each row of magnets has a receiving bar 108 parallel and adjacent thereto. Each receiving bar 108 has a plurality of channels 110 which are enclosed at the end opposite the magnets. In the preferred embodiment there are 75 pairs of magnets and 75 corresponding channels on each row. Each channel 110 is respectively positioned directly adjacent to one pair of magnets so that as the drum revolves, gravity encourages the glass ends of the bulbs whose leads have been properly aligned by the pair of magnets to lie within the adjacent channel. Attached to each receiving bar 108, by a spring 112, is a flexible clamp 114, shown in detail in FIGS. 8 and 9. Each clamp confines the glass ends of the bulbs which lie within the channels when the clamp is shut.

At one end of each clamp 114 is a weight 118 attached to spring 112. At the other end of each clamp is a gear 120 which controls the open and shut motion of the clamp. When gear 120 engages the gear teeth of a rack (not shown) affixed to support member 46, the gear is driven in rotation to flip weight 118 over such that the flexible edge of the clamp confines the glass ends of the bulbs within the channels.

Referring next to FIGS. 4 through 6, a portion of the chain conveyor 12 is shown having a plurality of rows of grippers 132 affixed to the outside of several of the link thereof. Each gripper 132 on each row of grippers has a common upper L-shaped jaw 134 and a common comblike lower jaw 136 springedly attached to the upper jaw 134. Each prong 136*a* of the lower jaw corresponds to channel 110 in a receiving bar 108 on drum 16. The spring mechanism 137 of lower jaw 136 is controlled by a lever 138 attached thereto having a sloped end which opens the jaw when the sloped end engages a wall 140 affixed behind the belt 12.

Referring next to FIGS. 4–9, in operation, the drum 16 revolves clockwise while the conveyor 12 moves counterclockwise. Between the six o'clock and seven o'clock position of drum 16, each pair of magnets 104 on each parallel row will attract and align a plurality of leads of the bulbs on the surface of feeder bin 15 such that a high percentage of the pairs of magnets on a row have attracted and aligned the leads 106 of a plurality of bulbs. Non-aligned bulbs are not sufficiently retained and drop into bin 15 for reloading. On each row of magnets, the pairs of magnets 104 create a strong enough force on the leads to support aligned bulbs, but to allow the aligned bulbs to sag around the outer circumference of the drum 16 (from approximately the six o'clock to the nine o'clock position) until gravity encourages the glass portions of the bulbs into the channels 110 directly adjacent to the pairs of magnets from which they hang, such as is shown at the nine o'clock position in FIG. 4, or as shown in FIG. 8.

From the eleven o'clock to the three o'clock position of the drum 16, the probe rod 122 on the receiving bar engages the wall 124 of cam 126. As the rod is deflected along the wall of cam 126, the receiving bar 108 rotates radially outward until the leads 106 point perpendicularly outward from the drum 16, away from the magnets, such that they are fully exposed, as is shown in FIG. 7. At the twelve o'clock position, the leads of the bulbs that are elevated by the upward radial motion caused by rod 122 against cam 126. The leads are straightened by the forward and downward brushing motion of the bristles of brush 56. The bulbs are restrained by restraining plate 108*a* and the downward pressure of the brush. Also any misaligned bulbs are removed. At the one o'clock position, the gear 120 on the clamp 114 (single in the preferred embodiment) engages the gear teeth of the rack (not shown) and is driven in rotation to flip the weight 130 over such that the flexible edge of the clamp 114 (vinyl in the preferred embodiment) confines the glass end of each bulb in a channel 110.

At the same time that drum 16 is revolving, the grippers 132 on the conveyor 12 are moving counterclockwise. When the sloped edges of levers 138 of each row of grippers contact the wall 140, the levers will be deflected along the length of the wall 140 causing the spring mechanism to open the lower jaw 136. At the three o'clock position of the drum 16, the probe 130 on the receiving bar contacts and rests upon the upper jaw 134 of the gripper 132 such that the leads of the bulbs are placed between the upper and lower jaws of the grippers 132. As the sloped end of lever 138 moves beyond the wall 140, the lower jaw 136 will close. At the same time drum 16 and receiving bar 108 move down and rotate radially inward thereby allowing the glass portions of the bulbs to be pulled from the channels. The leads of the bulbs are thus mechanically gripped by the gripper 132 such that the glass portions are exposed and hang downward from the conveyor 12. FIG. 6 illustrates a row of grippers 132 in which the leads 106 of the bulbs have been gripped between the upper and lower jaws 134 and 136. The gripped bulbs are thereby ready to be conveyed through the machine for coating.

FIG. 10 illustrates the coating tank 150 utilized in the preferred embodiment of the present invention. However, any suitable coating tank that provides uniform viscosity along the coating area 26 of the conveyor path may be utilized.

Tank 150 is placed in area 26 between support mmbers 48 and 50 and is as wide as the width of conveyor belt 12. Tank 150 has a pneumatic lever (not shown) which raises it into a fixed position in area 26 under the conveyor belt 12. The paint level 151 in the upper portion 153 of the tank is maintained by an overflow valve 152 which recirculates the paint into a reservoir 154. The overflow valve 152 has a lip 155 which forms a seal against the support member of the machine to prevent all of the paint in the upper portion from flowing into the reservoir 154. The tank 150 may contain separate reservoirs which store different colors allowing a color change to be made within a few minutes.

The paint is pumped into the upper portion 153 from reservoir 154 by a pump 156 connected to a controller 158 which maintains the viscosity of the paint in the upper portion. When the painting is finished the lip 155 is lowered and the paint in the upper portion 153 will be released into reservoir 154.

The bulbs travel through the paint in the upper portion 153 of the tank 150 for a period of approximately 10 seconds such that the leads remain substanially unpainted. The bulbs are gradually lifted out of the paint which causes the excess paint on the bulbs to be drawn off, due to the surface tension of the paint which is maintained by the viscosity controller 158.

The process is continually repeated for each row of gripped bulbs. The bulbs are then conveyed into oven **24*b* where they are cured. The bulbs may be recoated in a tank similar to tank 150 prior to final curing which is placed in area 30. Otherwise, the bulbs are conveyed into oven 24*c* for final curing. After the bulbs have been finally cured and the conveyor has travelled around sprockets 38, 40 and 42 the lever on the jaw comes into contact with a wall (not shown) which causes it to open the lower jaw of the grippers. The ungripped coated bulbs fall into an unloading unit (not shown). If any bulbs remain affixed to the jaws of the conveyor due to dried paint that may have dripped down on the leads, these bulbs are knocked off by brush 68** into a separate unloading unit.

The machine of the present invention is a substantial improvement over the prior art of manually dipping the small light bulbs into paint. The feeding system of the invention provides a way to coat over 2000 bulbs a minute at 60% operating efficiency for a total of approximately one million bulbs per 16 hour work day.

Obviously, while the invention has been disclosed and described with respect to a specific preferred embodiment thereof, it will be understood by those skilled in the art that various changes in form and detail may be made therein without departing from the spirit and scope of the invention.

What is claimed is:

1. An automatic coating and material handling machine for coating a plurality of objects, each object having a first magnetic end and a second end, comprising:

revolving drum means having magnetic means for attracting the plurality of magnetic ends and having a receiving means adjacent and parallel to said magnetic means for containing the plurality of second ends of the objects, clamping means for confining the plurality of second ends of the objects within said receiving means, wherein said receiving means is revolved whereby the plurality of magnetic ends are exposed, conveyor means having a plurality of gripper means for gripping the plurality of exposed magnetic ends, said clamping means simultaneously releasing the second ends such that the second ends hang underneath said gripper means, said conveyor means conveying the plurality of gripped objects through the machine, and coating means for uniformly coating the exposed second ends of said gripped objects on said conveyor means such that the magnetic ends remain uncoated.

2. The machine of claim 1 further comprising:

cleaning means for cleaning the plurality of exposed second ends of said objects on said conveyor means prior to being conveyed to said coating means.

3. The machine of claim 2, further comprising drying means for drying said cleaned objects prior to being conveyed to said coating means.

4. The machine of claim 1, further comprising:

straightening means for straightening the magnetic ends of the objects such that they may be easily gripped by said gripper means.

5. The machine of claim 3, further comprising:

cooling means for cooling said objects after they are dried such that the objects will be at an optimal temperature for being coating in said coating means.

6. The machine of claim 1, further comprising evaporating means for evaporating any excess coating on the coated objects.

7. The machine of claim 1, further comprising curing means for final curing of the coated objects.

8. The machine of claim 7, further comprising second coating means for applying a uniform second coat on said second ends of said objects after said first coat has dried prior to final curing of said objects.

9. The machine of claim 1, further comprising unloading means, causing said gripper means to release said coated objects into an unloading area.

10. The machine of claim 1, further comprising a plurality of second coating means for sequentially coating said second ends of said objects with a plurality of coats, each coat being applied after the previous coat has dried.

11. An automatic material handling and coating machine for coating a plurality of light bulbs, wherein the leads of the bulbs extend through the glass end to be coated, comprising:

a revolving drum having a plurality of parallel rows of pairs of magnets attached thereto for attracting the plurality of leads, a plurality of receiving bars having a plurality of channels therein configured to contain the plurality of glass ends of the bulbs, each of said bars being parallel and adjacent to one of said rows of magnets such that each of said channels is adjacent and directly beneath a pair of magnets, a plurality of clamps for clamping the glass ends of the bulbs against said channels in said receiving bar and having means for revolving said receiving bar, whereby the plurality of lead are exposed, a conveyor having a plurality of grippers affixed thereto, whereby when said drum revolves to a pick-up point, one of said grippers grips the exposed leads from one of said receiving bars while the clamp opens to release the glass ends, wherein said glass ends hang from said grippers by said leads and said conveyor conveys the plurality of gripped bulbs through the machine, and coating means for uniformly coating the glass ends on said conveyor, such that the leads remain uncoated.

12. The machine of claim 11, further comprising:

cleaning means for cleaning the glass ends of the bulbs prior to being coated.

13. The machine of claim 11, further comprising an oven for curing said coated bulbs.

14. The machine of claim 13, further comprising a plurality of coating means for sequentially coating the glass end of said bulbs with a plurality of coats, each coat being applied after the previous coat has been cured.

* * * * *

UNITED STATES PATENT AND TRADEMARK OFFICE

CERTIFICATE OF CORRECTION

PATENT NO. : 4,452,171

DATED : June 5, 1984

INVENTOR(S) : Browning

It is certified that error appears in the above-identified patent and that said Letters Patent is hereby corrected as shown below:

Column 3, line 66, delete "pain" and insert --paint--.

Column 7, line 9, delete "mmbers" and insert --members--.

Signed and Sealed this

*Twenty-eighth* Day of *January 1986*

[SEAL]

*Attest:*

DONALD J. QUIGG

*Attesting Officer*

*Commissioner of Patents and Trademarks*